US007014526B1

(12) United States Patent
Chamberlin

(10) Patent No.: US 7,014,526 B1
(45) Date of Patent: Mar. 21, 2006

(54) COMPUTER STRESS RELIEF METHOD AND DEVICE

(76) Inventor: James L. Chamberlin, 115 Barick Dr., Duncannon, PA (US) 17020

( * ) Notice: Subject to any disclaimer, the term of this patent is extended or adjusted under 35 U.S.C. 154(b) by 107 days.

(21) Appl. No.: 09/813,743

(22) Filed: Mar. 21, 2001

Related U.S. Application Data

(60) Provisional application No. 60/191,577, filed on Mar. 23, 2000.

(51) Int. Cl.
*A63H 5/00* (2006.01)

(52) U.S. Cl. ..... 446/404; 446/397; 446/491; 248/694

(58) Field of Classification Search ..... 446/297, 446/397, 404; 273/440, 440.1, 454; 463/8, 463/7; D21/787; 482/87, 86, 83; 248/442.2, 248/94, 447.1, 289.11
See application file for complete search history.

(56) References Cited

U.S. PATENT DOCUMENTS

| | | | | | |
|---|---|---|---|---|---|
| 2,661,212 | A | * | 12/1953 | Hilton | 248/324 |
| 4,216,957 | A | * | 8/1980 | Curatola | 482/90 |
| 4,465,273 | A | | 8/1984 | Aragona | 272/78 |
| 4,634,116 | A | | 1/1987 | Amador et al. | 272/77 |
| 4,693,443 | A | * | 9/1987 | Drain | 248/447.1 |
| 4,928,954 | A | | 5/1990 | Levine et al. | 272/8 |
| 4,941,660 | A | * | 7/1990 | Winn et al. | 273/454 |
| 4,953,852 | A | * | 9/1990 | Donohue | 482/87 |
| 5,067,681 | A | * | 11/1991 | Huang et al. | 248/316.7 |
| 5,072,998 | A | * | 12/1991 | Oh | 312/204 |
| 5,195,917 | A | | 3/1993 | Russell et al. | 446/97 |
| 5,211,282 | A | * | 5/1993 | Ting | 200/303 |
| 5,297,768 | A | * | 3/1994 | Denton | 248/205.2 |
| 5,564,209 | A | | 10/1996 | Zagnoli | 40/594 |
| 5,687,945 | A | * | 11/1997 | Lee | 248/276.1 |
| 5,733,193 | A | * | 3/1998 | Allard et al. | 463/8 |
| 5,830,109 | A | * | 11/1998 | Juarez | 482/44 |
| 5,895,308 | A | | 4/1999 | Spector | 446/397 |
| 6,005,204 | A | | 12/1999 | Choi et al. | 200/52 |
| 6,129,606 | A | * | 10/2000 | Yuen | 446/325 |
| 6,133,823 | A | * | 10/2000 | Brown et al. | 340/384.7 |
| 6,199,814 | B1 | * | 3/2001 | Lee | 248/442.2 |
| 6,234,940 | B1 | * | 5/2001 | Fotsis | 482/83 |
| 6,533,634 | B1 | * | 3/2003 | Sugar | 446/72 |
| 6,544,099 | B1 | * | 4/2003 | Shafik | 446/404 |

OTHER PUBLICATIONS

YO1 Magazine-Cilty life covered, Jul.,Workers playtime, 3 pages.*
Branders.com-Website,Stress Reliever-Computer Spring Thing.*

* cited by examiner

*Primary Examiner*—Derris H. Banks
*Assistant Examiner*—Alex F. R. P. Rada, II
(74) *Attorney, Agent, or Firm*—The Webb Law Firm

(57) ABSTRACT

A computer-related stress relief device is configured to be mounted on a computer component. The device includes a support having a connector that is releasably engageable with the computer component and a punching bag-shaped contact element movably mounted on the support and spaced from the connector. The contact element can include a sound-producing device and/or display indicia.

12 Claims, 2 Drawing Sheets

22
14
12
3
10

COMPUTER STRESS RELIEF METHOD AND DEVICE

CROSS-REFERENCE TO RELATED APPLICATION

This application claims the benefits of U.S. Patent Application Ser. No. 60/191,577 filed Mar. 23, 2000, herein incorporated by reference in its entirety.

FIELD OF THE INVENTION

This invention relates generally to stress relieving devices and, more particularly, to a method and device for relieving computer related stress.

TECHNICAL CONSIDERATIONS

In today's fast-paced environment, workplace stress is of growing concern. In order to function efficiently, workers must be able to relieve pent-up stress and frustration associated with their work. This stress is particularly acute with workers who must use computers on a daily basis. If not relieved, such stress can result in poor work product, job frustration, or at an extreme, to individuals venting their frustration by damaging the computer.

Stress relieving devices are known in the field of sports. For example, U.S. Pat. No. 5,195,917 discloses a stress relieving doll resembling a sports referee. The doll has leg elements, arm elements, and a head element that can be torn off of the doll to relieve the stress of a sports fan caused by a "bad call". However, dismembering a doll would probably not be acceptable behavior in a typical work environment.

Decorative devices which can be attached to computer monitors are known. For example, U.S. Pat. Nos. 5,072,998 and 5,564,209 disclose decorative devices in the form of stuffed animal parts that can be attached to a computer monitor to make the computer appear less intimidating, particularly to children. However, these decorative devices are not designed to interact with the computer operator to relieve stress.

Therefore, it would be advantageous to provide a stress relief device, particularly an interactive stress relief device, that can be used to relieve stress, such as workplace stress.

SUMMARY

A method of relieving computer-related stress in accordance with the invention comprises connecting a stress relief device to a computer component. The stress relief device includes a support and a contact element connected to the support. The method includes striking or squeezing the contact element to relieve stress.

Another method of relieving stress in accordance with the invention comprises removably mounting a stress relief device at an operator station. The stress relief device includes a support and a contact element movably mounted on the support. The method includes contacting the contact element to relieve stress, for example, by striking the contact element.

An interactive computer-related stress relief device configured to be mounted on a computer component is provided. The device includes a support connectable with the computer component and a contact element connected to the support.

A computer-related stress relief device configured to be mounted on a computer component is also provided. The device includes a support having a connector that is releasably engageable with the computer component and a punching bag-shaped contact element movably mounted on the support and spaced from the connector. The contact element includes a sound-producing device and display indicia.

A computer system of the invention comprises a computer component having an engagement element, a support having a first end and a second end, a connector located at or near the first end of the support and releasably connectable with the engagement element on the computer component, and a punching bag-shaped contact element movably connected to the support at or near the second end of the support.

BRIEF DESCRIPTION OF THE DRAWINGS

A complete understanding of the invention will be obtained from the following description when taken in connection with the accompanying drawing figures where like reference numbers identify like parts throughout.

DESCRIPTION OF THE PREFERRED EMBODIMENTS

Figure 1:
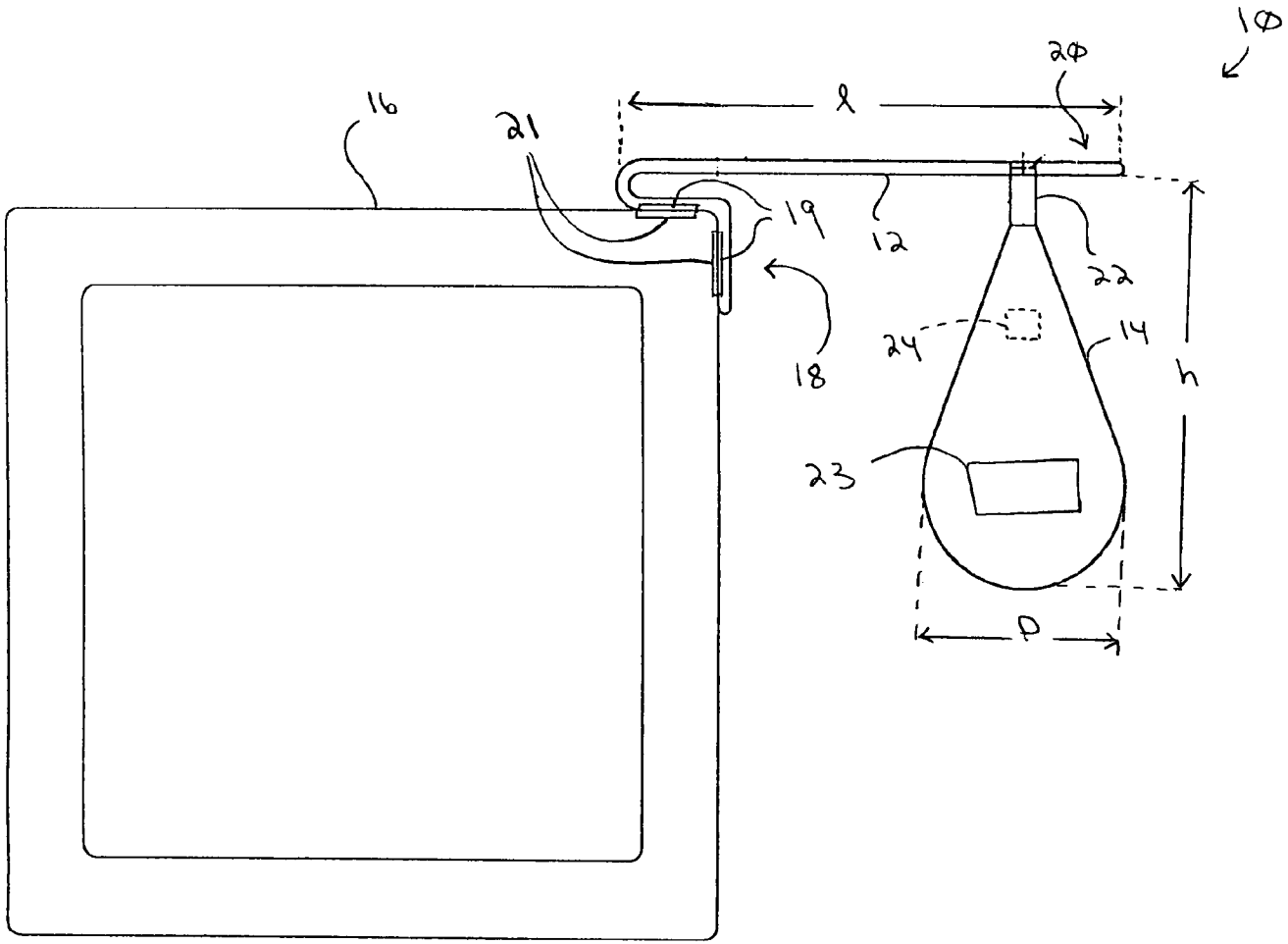
FIG. 1 is a front view of a stress relief device of the invention connected with a conventional computer monitor.

As used herein, spatial or directional terms, such as "left", "right", "inner", "outer", "above", "below", "top", "bottom", and the like, relate to the invention as it is shown in the drawing figures. However, it is to be understood that the invention may assume various alternative orientations and, accordingly, such terms are not to be considered as limiting. Further, as used herein, all numbers expressing dimensions, physical characteristics, and the like used in the specification and claims are to be understood as being modified in all instances by the term "about". Accordingly, unless indicated to the contrary, the numerical values set forth in the following specification and claims are approximations that may vary depending upon the desired properties sought to be obtained by the present invention. At the very least, and not as an attempt to limit the application of the doctrine of equivalents to the scope of the claims, each numerical value should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 5.5 to 10.

The structural components of an exemplary stress relief device of the invention will first be described with regard to use with a conventional computer system and then an exemplary method of using the stress relief device will be described. However, it is to be understood that the specifically disclosed device and method are presented simply to explain the general concepts of the invention and that the invention is not limited to these specifically disclosed embodiments or limited to use with computer systems.

As shown in FIG. 1, a stress relief device 10 of the invention comprises a support 12 and a contact element 14 connected to the support 12. As described in more detail below, the stress relief device 10 can be located at a work station or operator station to be used by a worker or operator to relieve stress. The particular type of workstation or operator station is not limiting to the invention. For example, the operator station could be a desk in a business office, the driver's seat of a vehicle, and the like. For purposes of the following explanation, the invention will be described with respect to use with a conventional computer system. Therefore, in the exemplary embodiment shown in FIGS. 1 and 2 and discussed in more detail below, the stress relief device 10 is shown attached to a conventional computer monitor 16.

The support 12 is preferably rigid or substantially rigid and may comprise pliable or shock absorbing material, such as wood; metal; plastic, e.g., Lexan; or combinations thereof. By "substantially rigid" is meant that the support 12 maintains the contact element 14 at or near a fixed position with respect to the item to which it is attached, e.g., the computer monitor 16. However, the substantially rigid support 12 preferably can resiliently bend or flex to absorb or counteract forces applied during use of the stress relief device 10, as described below. The support 12 preferably has a first end or region 18 and a second end or region 20. The first end 18 may be connectable with the computer monitor 16 in any conventional manner. For example, the first end 18 can be rigidly connected to the monitor 16 by glue, screws, bolts, or other similar mounting devices. However, in a preferred embodiment, the first end 18 includes one or more connectors 19 which can be removably connected with one or more engagement elements 21 on the monitor 16 such that the stress relief device 10 may be removed from the monitor 16 and stored as desired. For example, as shown in FIG. 1, the connector(s) 19 can include one or more Velcro type fasteners and the engagement element(s) 21 can include one or more other Velcro type fasteners releasably engageable with the Velcro fasteners on the support 12. Alternatively, the connector(s) 19 and engagement element(s) 21 can be configured as a conventional bayonet-type mounting system to hold the stress relief device 10 in place on the monitor 16 during use but then allow the device 10 to be quickly and easily removed for storage.

Figure 2:
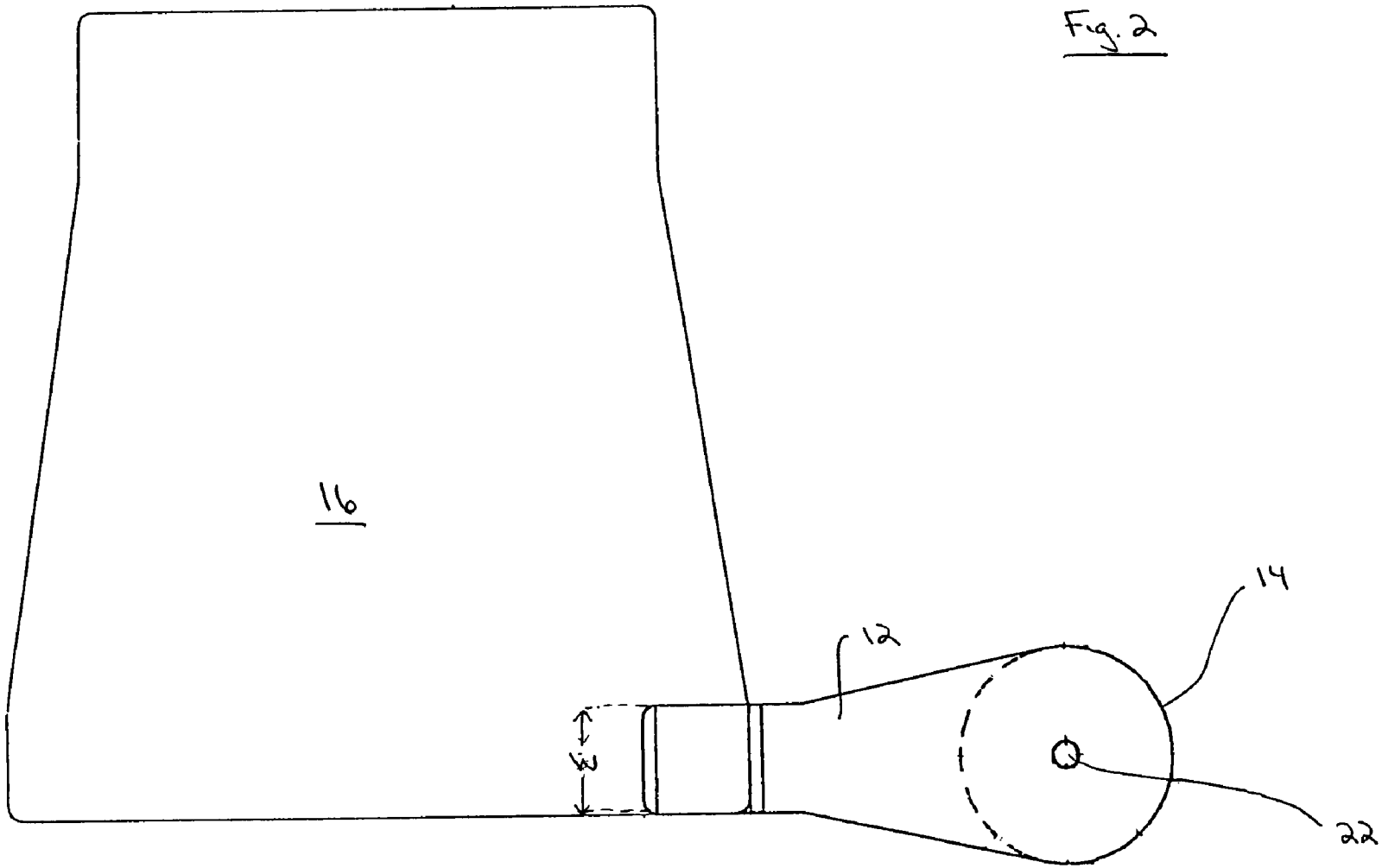
FIG. 2 is a plan view of the device shown in FIG. 1.

As shown in FIGS. 1 and 2, the support 12 extends away from the monitor 16 and the contact element 14 is connected to the support 12 at or near the second end 20. The contact element 14 depends from the support 12. The contact element 14 is preferably movably connected to the support 12, such as by a spring 22 or similar flexible member, to allow the contact element 14 to move relative to the support 12. The contact element 14 may be removably mounted to the support 12 in any conventional manner such that different. contact elements 14 can be used, i.e., connected to the support 12, as a user desires. For example, the contact element 14 can include a tab or key which engages a slot or keyway in the support 12. Alternatively, the contact element 14 can be permanently mounted to the support 12.

In the embodiment of the invention shown in FIGS. 1 and 2, the contact element 14 is shaped like a conventional punching bag. The punching bag-shaped contact element 14 may be formed of a unitary piece of material or may be comprised of several separate pieces of material sewn together. The contact element 14 is preferably made of impact and tear resistant material, such as plastic, nylon, leather, cloth, and the like. The contact element 14 can contain or can be filled with shock absorbent or resilient material, such as foam, saw dust, or similar material. Alternatively, the contact element 14 may be inflated with or may contain air, water, or similar fluid.

Although in the exemplary embodiment shown in FIGS. 1 and 2 the contact element 14 is shaped like a conventional teardrop-shaped punching bag, the contact element 14 is not limited to this particular punching bag shape. The contact element 14 can be of any desired shape, such as for example, round or cylindrical. Alternatively, the contact element 14 may be shaped like an animal, human, sports figure, or cartoon character, just to name a few.

The contact element 14 may have display indicia 23 located on at least a portion of the contact element 14. Such display indicia 23 can be, for example, advertising or promotional logos or slogans; company names; service provider names; logos or names of sports teams, such as college or professional football, baseball, basketball, or hockey teams; and the like.

In one embodiment of the invention, a sound-producing device 24, such as a conventional sound chip, can be operationally connected with the contact element 14. For example, the sound-producing device 24 can be contained within the contact element 14 surrounded by filler material, such as foam or saw dust. The sound-producing device 24 can be of any conventional type, such as an integrated circuit chip in which sounds to be reproduced are digitally stored on a memory device, such as a recordable memory device or a read only memory device. The sound-producing device 24 can be connected to a conventional impact sensitive switch such that when the contact element 14 is struck or squeezed the switch connects the circuit chip to a battery to emit the prerecorded sound. The prerecorded sound can be of any desired type, such as but not limited to a song, a slogan, or saying. Examples of such conventional sound-producing devices are disclosed, for example, in U.S. Pat. Nos. 5,895,308 and 6,005,204, herein incorporated by reference.

The stress relief device 10 of the invention can be provided separately or can be incorporated into a computer system and provided with the computer system itself when the computer system is purchased. Alternatively, the stress relief device 10 can be provided as a kit and installed on an existing computer system. For example, the kit can include one or more Velcro strips or similar elements that can be attached, e.g., glued or adhered, onto the monitor to function as engagement elements 21 as described above.

In operation, the stress relief device 10 of the invention may be connected with an item at a workstation or operator station, such as the computer monitor 16, at the beginning of the workday and left in place until heeded. For example, the stress relief device 10 can be attached or removably mounted to the monitor 16 by engaging the connector(s) 19 with the engagement element(s) 21. By "removably mounted" or "removably mounting" is meant that the stress relief device 10 may be attached and detached as desired. When an operator undergoes a particularly stressful event or is feeling under stress, the operator can squeeze or strike the contact element 14 with his hand or fist to help relieve the stress. The stress relief device 10 can be removed from the monitor 16 at the end of the workday by disengaging the connector(s) 19 from the engagement element(s) 21 and stored until the following day or when next needed.

Although not to be considered as limiting to the invention, in the specific exemplary embodiment of the stress relief device 10 shown in FIGS. 1 and 2, the support 12 has a length l of about 10 inches (25 cm) and a width w at the first end 18 of about 2 inches (5 cm). The contact element 14 has an overall height h of about 8 inches (20 cm) including the spring 22 (about 1 inch (2.5 cm)) and a diameter d of about 4 inches (10 cm).

It will be readily appreciated by those skilled in the art that modifications may be made to the invention without departing from the concepts disclosed in the foregoing description. For example, although the exemplary stress relief device of the invention is shown attached to a conventional computer monitor in FIGS. 1 and 2, it will be understood by one of ordinary skill in the art that the invention could be connectable with not only a conventional television type monitor but also with a laptop-type computer. Additionally, the stress relief device could be a free standing device, i.e., mounted on a support frame, which may be simply placed at or near a computer screen or other similar high stress position without necessarily being attached directly to the computer component. Further, the stress relief device of the invention is not limited to use with computers. The stress relief device can be mounted, for example but not to be considered as limiting, on the dashboard of a vehicle to help reduce driving stress or "road rage", on or adjacent a telephone, on a worker's desk, on the wall of a worker's cubicle, etc. Accordingly, the particular exemplary embodiments described herein are illustrative only and are not to be considered as limiting the scope of the invention, which is to be given the full breadth of the appended claims and any and all equivalents thereof.

What is claimed is:

1. An interactive computer-related stress relief device configured to be mounted on a desktop computer monitor of a computer system to relieve computer-related stress of a computer operator, the device comprising:

a substantially rigid support having a first end and a second end, with the first end comprising a substantially L-shaped member having a first side connectable with a top of a desktop computer monitor and a second side connectable with a side of the computer monitor; and a contact element connected at or near the second end of the support, wherein the contact element is a punching bag and includes a sound-producing device inside the punching bag such that a pre-recorded sound is emitted when the punching bag is struck.

2. The device as claimed in claim 1, wherein the contact element includes indicia selected from the group consisting of advertising logos, promotional logos, slogans, company names, service provider names, sports team logos, and sports team names.

3. The device as claimed in claim 1, wherein the punching bag is movably connected to the support.

4. The device as claimed in claim 1, wherein the support is an elongated, plastic member.

5. An interactive computer-related stress relief device configured to be mounted on a desktop computer monitor of a computer system to relieve computer-related stress of a computer operator, the device comprising:

a support having a first end and a second end, wherein the first end comprises a substantially L-shaped member having a first side connectable with a top of a desktop computer monitor and a second side connectable with a side of the computer monitor; and a contact element movably connected at or near the second end of the support, wherein the contact element is a punching bag, and wherein the support is configured to maintain the punching bag at a spaced position from the monitor.

6. The device as claimed in claim 5, wherein the contact element includes indicia selected from the group consisting of advertising logos, promotional logos, slogans, company names, service provider names, sports team logos, and sports team names.

7. The device as claimed in claim 5, wherein the punching bag depends from the support.

8. An interactive computer-related stress relief device configured to be mounted on a desktop computer monitor of a computer system to relieve computer-related stress of a computer operator, the device comprising:

a support connectable with the desktop computer monitor; and a contact element connected to the support, wherein the support is an elongated, rigid member having a first end and a second end, with the first end comprising a substantially L-shaped member having a first side connectable with a top of the computer monitor and a second side connectable with a side of the computer monitor, wherein the contact element is a punching bag and is movably connected to the support at a position spaced from the connector, and wherein the contact element includes a sound-producing device.

9. The device as claimed in claim 8, wherein the contact element includes indicia selected from the group consisting of advertising logos, promotional logos, slogans, company names, service provider names, sports team logos, and sports team names.

10. An interactive computer-related stress relief device configured to be mounted on a desktop computer monitor of a computer system to relieve computer-related stress of a computer operator, the device comprising:

a support having a first end and a second end, with the first end comprising a substantially L-shaped member having a first side connectable with a top of a desktop computer monitor and a second side connectable with a side of the computer monitor; and a contact element connected at or near the second end of the support, wherein the contact element is a punching bag and includes display indicia selected from the group consisting of advertising logos, promotional logos, slogans, company names, service provider names, sports team logos, and sports team names.

11. The device as claimed in claim 10, wherein the punching bag depends from the support.

12. The device as claimed in claim 10, wherein the punching bag is movably connected to the support.

* * * * *